US005538447A

United States Patent [19]

Chadbourne et al.

[11] Patent Number: 5,538,447

[45] Date of Patent: Jul. 23, 1996

[54] ELECTRICAL WEDGE CONNECTOR

[75] Inventors: Richard Chadbourne, Merrimack; William J. Lasko, Lisbon, both of N.H.

[73] Assignee: Burndy Corporation, Norwalk, Conn.

[21] Appl. No.: 353,519

[22] Filed: Dec. 9, 1994

[51] Int. Cl.[6] ..... H01R 4/50

[52] U.S. Cl. ..... 439/783; 439/863; 174/94 R

[58] Field of Search ..... 439/783–785, 439/863; 174/94 R, 94 S

[56] References Cited

U.S. PATENT DOCUMENTS

| | | | |
|---|---|---|---|
| 2,106,724 | 2/1938 | Cope | 173/273 |
| 2,814,025 | 11/1957 | Wade et al. . | |
| 2,828,147 | 3/1958 | Peiffer | 285/138 |
| 3,065,449 | 11/1962 | Matthysse et al. . | |
| 3,275,974 | 9/1966 | Mixon, Jr. . | |
| 3,329,928 | 7/1967 | Broske . | |
| 3,349,167 | 10/1967 | Mixon, Jr. et al. | 174/94 |
| 3,462,543 | 8/1969 | Wahl et al. | 174/94 |
| 3,504,332 | 3/1970 | Mixon, Jr. . | |
| 3,516,050 | 6/1970 | Mixon, Jr. et al. . | |
| 3,588,791 | 6/1971 | Polidori . | |
| 3,920,310 | 11/1975 | Walsh et al. . | |
| 4,059,333 | 11/1977 | Mixon, Jr. . | |
| 4,533,205 | 8/1985 | Frank . | |
| 4,600,264 | 7/1986 | Counsel . | |
| 4,634,205 | 1/1987 | Gemra . | |
| 4,650,273 | 3/1987 | Roosdrop . | |
| 4,723,920 | 2/1988 | Werner | 439/782 |
| 4,723,921 | 2/1988 | Pooley | 439/783 |
| 4,730,087 | 3/1988 | Werner | 174/94 S |
| 4,734,062 | 3/1988 | Goto | 439/783 |
| 4,813,894 | 3/1989 | Mixon, Jr. | 439/783 |
| 4,863,403 | 9/1989 | Shannon | 439/783 |
| 4,872,856 | 10/1989 | Pooley et al. | 439/783 |
| 4,915,653 | 4/1990 | Mair | 439/781 |
| 5,006,081 | 4/1991 | Counsel et al. | 439/783 |
| 5,044,996 | 9/1991 | Goto | 439/783 |
| 5,145,420 | 9/1992 | Counsel et al. | 439/783 |
| 5,244,422 | 9/1993 | Laricchia | 439/783 |

OTHER PUBLICATIONS

"Ampact Grounding System", AMP Corporation, Mar. 1988, pp. 1–16.

*Primary Examiner*—P. Austin Bradley
*Assistant Examiner*—Jill DeMello
*Attorney, Agent, or Firm*—Perman & Green

[57] ABSTRACT

An electrical connector with a C-shaped sleeve and a one-piece wedge. The wedge has two opposite ends adapted to sandwich conductors against the sleeve and a center section. The center section has outwardly laterally bowed sections. The bowed sections are sequentially oppositely outwardly bowed along the length of the wedge. The wedge is preferably formed from an extruded or formed I-beam shaped member.

12 Claims, 2 Drawing Sheets

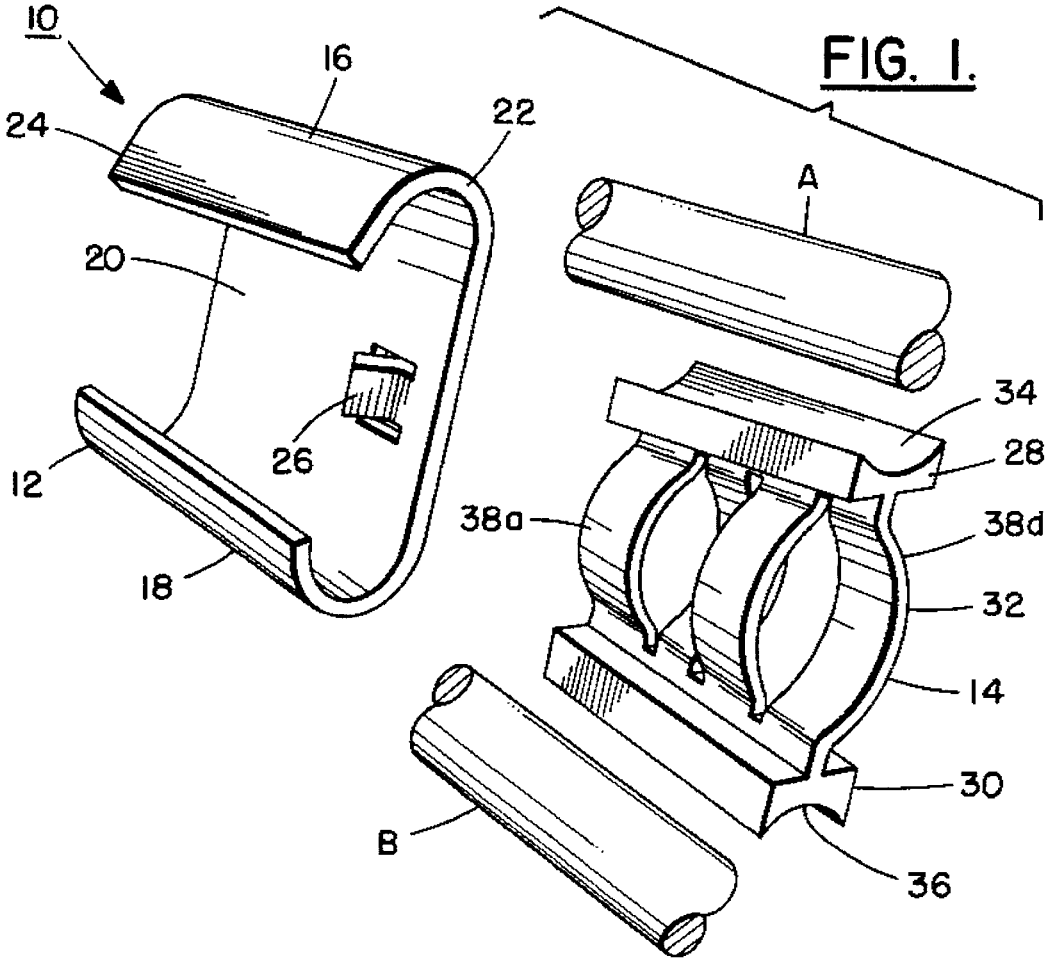
FIG. 1.
FIG. 2B.
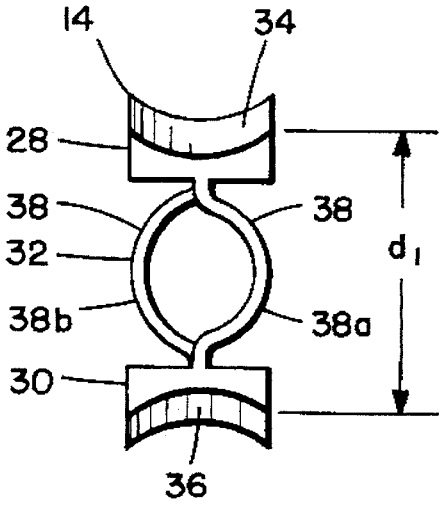
FIG. 2A.
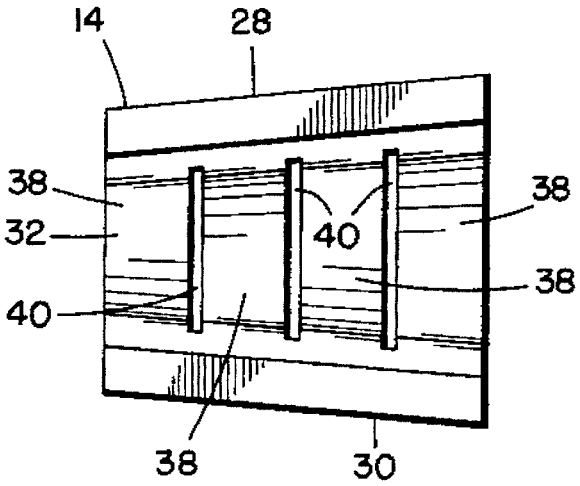

ELECTRICAL WEDGE CONNECTOR

BACKGROUND OF THE INVENTION

1. Field of the Invention

The present invention relates to electrical connectors and, more particularly, to a wedge connector.

2. Prior Art

U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge. Other U.S. Patents that relate to wedge connectors include the following:

| | |
|---|---|
| 2,106,724 | 2,814,025 |
| 2,828,147 | 3,065,449 |
| 3,275,974 | 3,329,928 |
| 3,349,167 | 3,462,543 |
| 3,504,332 | 3,516,050 |
| 3,588,791 | 3,920,310 |
| 4,059,333 | 4,533,205 |
| 4,600,264 | 4,634,205 |
| 4,723,920 | 4,723,921 |
| 4,730,087 | 4,734,062 |
| 4,813,894 | 4,863,403 |
| 4,872,856 | 4,915,653 |
| 5,044,996 | 5,145,420 |
| 5,244,422 | |

SUMMARY OF THE INVENTION

In accordance with one embodiment of the present invention, an electrical wedge connector is provided comprising a sleeve and a one-piece wedge. The sleeve has a general cross sectional C-shape. The wedge has two opposite ends adapted to sandwich conductors against the sleeve and a center section having outwardly bowed sections between the two opposite ends. The bowed sections are sequentially oppositely outwardly bowed along the length of the wedge.

In accordance with another embodiment of the present invention, an electrical wedge connector is provided comprising a sleeve and a one-piece wedge. The wedge has an I-beam member with a center span that has been cut and deformed such that ends of the member on opposite ends of the center span form a wedge shaped profile.

In accordance with one method of the present invention, a method of forming a wedge for an electrical wedge connector is provided comprising steps of providing a member having a generally uniform I-beam shape; cutting a center span of the member; and deforming the center span to form a general wedge shape along the length of the member.

In accordance with another method of the present invention, a method of forming a wedge for an electrical wedge connector is provided comprising steps of extruding a member of a metallic material in a general uniform I-beam shape; and deforming a center span of the I-beam shaped member to form a wedge shape along the length of the member.

BRIEF DESCRIPTION OF THE DRAWINGS

The foregoing aspects and other features of the invention are explained in the following description, taken in connection with the accompanying drawings, wherein:

FIG. 1 is an exploded perspective view of a wedge connector incorporating features of the present invention with two conductors;

FIG. 2A is an elevational side view of the wedge shown in FIG. 1;

FIG. 2B is an elevational front view of the wedge shown in FIG. 2A;

DETAILED DESCRIPTION OF THE PREFERRED EMBODIMENT

Figure 2C:
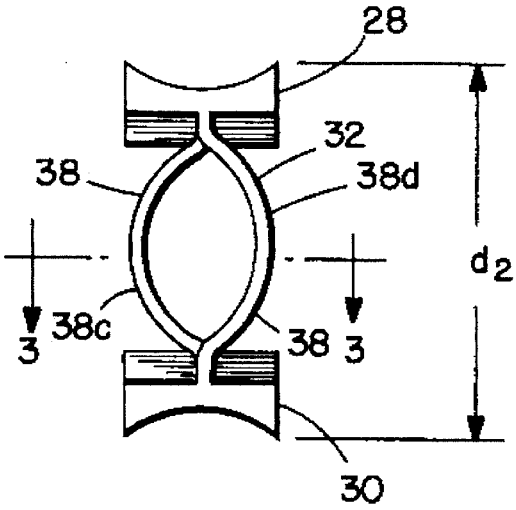
FIG. 2C is an elevational rear view of the wedge shown in FIG. 2A.
Figure 3:
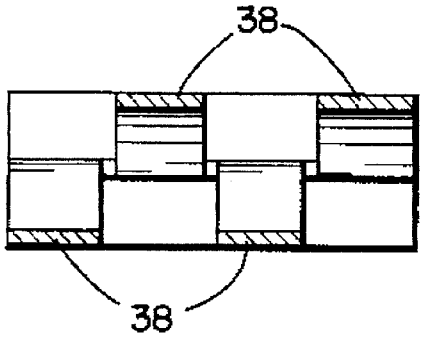
FIG. 3 is a cross-sectional view of the wedge shown in FIG. 2C taken along line 3—3.

Referring to FIG. 1, there is shown an exploded perspective view of an electrical wedge connector 10 incorporating features of the present invention with two conductors A, B. Although the present invention will be described with reference to the single embodiment shown in the drawings, it should be understood that features of the present invention can be embodied in various different forms of embodiment. In addition, any suitable size, shape or type of materials or elements could be used.

The connector 10 generally comprises a sleeve or shell 12 and a wedge 14. The sleeve 12 is preferably made of sheet metal, but it could also be a cast, drawn, or extruded member. The sleeve 12 has two opposing channel sections 16, 18 interconnected by a middle section 20 to form a general "C" shape. The "C" shape tapers from the rear end 22 to the front end 24. The middle section 20 includes an inwardly projecting rear end tab 26.

Referring also to FIGS. 2A–2C and 3, the wedge 14 is a one-piece member preferably made of metal. The wedge has a top section 28, a bottom section 30, and a center section 32. The top section 28 forms a top end with an inwardly curved conductor contacting surface 34. The bottom section 30 forms an opposite bottom end with an inwardly curved conductor contacting surface 36. The two surfaces 34, 36 are angled relative to each other such that the wedge 14 has a general shaped wedge profile as seen best in FIG. 2A. The surfaces 34, 36 can have any suitable type of shape or texture.

Figure 4A:
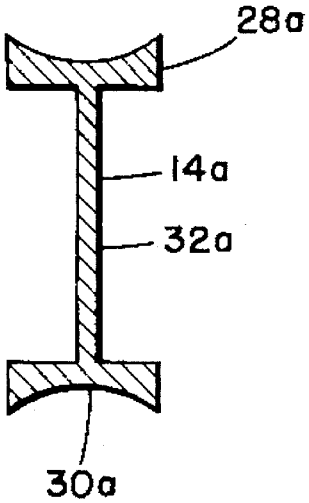
FIG. 4A is a cross sectional view of an I-beam member used to form the wedge of the connector shown in FIG. 1.
Figure 4B:
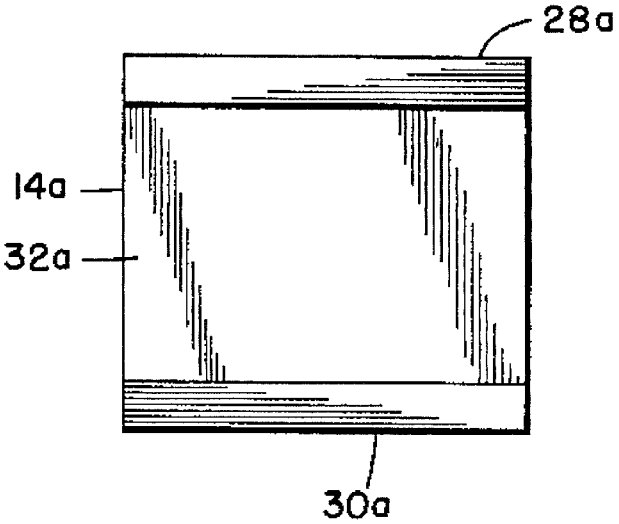
FIG. 4B is an elevational side view of the I-beam member shown in FIG. 4A.

The center section 32 is generally comprised of a plurality of outwardly bowed or bent sections 38. In the embodiment shown, the wedge has four bowed sections 38 that are sequentially oppositely outwardly bowed along the length of the wedge. Referring also to FIGS. 4A and 4B, the wedge 14 is comprised of a general I-beam shaped member 14*a* that is cut and deformed to form the wedge shape of the wedge shown in FIGS. 2A–2C. The member 14*a* has a top section 28*a* and a bottom section 30*a* substantially identical to the top and bottom sections of the final wedge 14. However, the top and bottom sections of the member 14*a* are generally parallel to each other. The center section 32*a* has a general uniform thickness and shape.

In order to form the wedge 14, the member 14*a* is first cut to form the slots 40 in the center section 32*a*. Then, the bowed sections 38 are formed. The bowed sections 38 are not uniformly bowed. More specifically, the dual web shape of the center section 32 has a diminishing width corrugated configuration along the length of the wedge from front to rear. The bowed section 38*a* at the front of the wedge 14 is more outwardly bowed than the rest of the bowed sections. The bowed section 38*d* at the rear of the wedge is less outwardly bowed than the rest of the bowed sections. The middle bowed sections 38*b* , 38*c* progressively decrease in their distance of outward bowing from the front section 38*a* to the rear section 38*d*. This progressively decreasing distance of outward bowing from the front bowed section 38*a* to the rear bowed section 38*d* allows the wedge 14 to have its general wedge shape even though it was originally a general I-beam shaped member with parallel top and bottom. As can be seen in comparing $d_1$ in FIG. 2B and $d_2$ in FIG. 2C, the front of the wedge 14 is smaller than the rear of the wedge 14.

When the wedge 14 is inserted into the sleeve 12, the bowed sections 38 are able to function as springs as the wedge is compressed. The tab 26 is able to be positioned behind one of the bowed sections 38. This can prevent the wedge from being inadvertently displaced from inside the sleeve 12. However, any suitable type of means could be used to lock the wedge 14 in the sleeve 12. In a preferred embodiment, the tab 26 locks behind the second bowed section 38*b* and, the front of the second bowed section 38*b* is coined to assist in passing over the tab 26. In addition, any suitable type of sleeve could be used with the wedge. As described above, a general I-beam shaped member is used to form the wedge. As used herein, the term "I-beam" is generally intended to mean a member with relatively wide cross-sectional top and bottom sections and a relatively thin, but high center section. It should also be understood that the terms "top" and "bottom" have been used herein for the purposes of description only. In a preferred embodiment, the I-beam member is made of copper in an extrusion process. However, any suitable material or process could be used.

In an alternate embodiment of the invention, the wedge 14 could have more or less than four bowed sections 38. In addition, the bowed sections 38 need not be alternatingly oppositely outwardly bowed. Although the sections 38 have been described as being "bowed" it should be understood that other types of shapes of outwardly laterally extending center sections, such as other types of bends, could be used. Therefore, the term "bowed" is intended to include such alternatives.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a sleeve having a general cross-sectional C-shape; and a one-piece wedge having two opposite ends adapted to sandwich conductors against the sleeve and a center section having outwardly bowed sections between the two opposite ends, the bowed sections being sequentially alternatingly oppositely outwardly bowed along the length of the wedge.

2. A connector as in claim 1 wherein the sleeve has a latch on an interior middle side which is engaged by an end of one of the bowed sections to lock the wedge in the sleeve.

3. A connector as in claim 1 wherein the wedge has four bowed sections of uniform cross-section.

4. A connector as in claim 1 wherein the wedge is comprised of an I-beam shaped member that is cut and deformed to form a wedge shape of the wedge.

5. A connector as in claim 4 wherein a first one of the bowed sections at a front of the wedge extends outwardly a greater distance than a second one of the bowed sections at a rear of the wedge.

6. A connector as in claim 5 wherein the bowed sections decrease in their outward bow between the front of the wedge to the rear of the wedge.

7. An electrical wedge connector comprising:

a sleeve; and a one-piece wedge adapted to be inserted into the sleeve, the wedge having an I-beam member with a center span that has been cut and deformed such that ends of the member on opposite ends of the center span form a wedge shaped profile.

8. A connector as in claim 7 wherein the center section has several portions along the length of the wedge separated by slots extending between the opposite ends of the center span.

9. A connector as in claim 7 wherein the I-beam member is an extruded member with the center section having a uniform height and thickness along the length of the I-beam member that is deformed into the wedge shaped profile.

10. A connector as in claim 7 wherein the center span has opposite outwardly laterally bowed sections.

11. A connector as in claim 10 wherein the opposite bowed sections alternate along the length of the wedge.

12. A connector as in claim 10 wherein the bowed sections decrease in their distance of outward bowing from a front of the wedge to a rear of the wedge.

* * * * *